United States Patent [19]

Beisswanger et al.

[11] Patent Number: 4,972,300

[45] Date of Patent: Nov. 20, 1990

[54] EMERGENCY LIGHTING DEVICE

[75] Inventors: David A. Beisswanger, North Plainfield; Bruce H. Baretz, West Milford, both of N.J.; Edward T. Rockwell, Jr.; Edward T. Rockwell, Sr., both of Leominster, Mass.

[73] Assignee: American Cyanamid Company, Stamford, Conn.

[21] Appl. No.: 396,483

[22] Filed: Aug. 21, 1989

[51] Int. Cl.[5] ..... F21K 2/00

[52] U.S. Cl. ..... 362/34; 362/190; 362/154; 206/137; 206/803

[58] Field of Search ..... 362/34, 84, 154, 391, 362/457, 190; 206/803, 804, 806, 1.5, 137; 252/700; 116/202, 206

[56] References Cited

U.S. PATENT DOCUMENTS

| | | | |
|---|---|---|---|
| 3,283,717 | 11/1966 | Balch | 206/803 |
| 3,584,211 | 6/1971 | Rauhut | 252/700 |
| 3,829,678 | 8/1974 | Holcombe | 362/34 |
| 3,875,602 | 4/1975 | Miron | 362/34 |
| 3,884,560 | 5/1975 | Neylan et al. | 206/803 |
| 4,061,910 | 12/1977 | Rosenfeld | 362/104 |
| 4,184,193 | 1/1980 | Heffernan et al. | 362/34 |
| 4,186,426 | 1/1980 | Ginpras, Sr. et al. | 362/154 |

*Primary Examiner*—Stephen F. Husar
*Assistant Examiner*—D. M. Cox
*Attorney, Agent, or Firm*—Steven H. Flynn

[57] ABSTRACT

An improved emergency chemiluminescent lighting device comprising a chemiluminescent light source, a storage container and a flexible member connecting the light source and container is disclosed herein.

5 Claims, 1 Drawing Sheet

EMERGENCY LIGHTING DEVICE

FIELD OF THE INVENTION

The invention claimed herein relates to an emergency lighting device which comprises a chemiluminescent light source, a container adapted for use in the storage and the display of the light source, and a flexible connecting member joining the light source to the container. Preferably, the light source is in the form of a lightstick.

BACKGROUND OF THE INVENTION

The utility of chemiluminescent light sources in emergency situations is well known. They are sources of chemically produced light which possess long term stability during storage. Moreover, the chemiluminescent reaction produces light without emission of heat, flame, sparks or gases; hence, the lightstick is safe for lighting in explosive environments and can be used without danger of causing fire or of burning the user. A well known commercially successful embodiment has come to be known as a lightstick which is a flexible plastic container which forms a light wand. Essentially a chemiluminescent lightstick comprises a flexible, transparent or translucent outer tube which enclose several chemical components of a chemiluminescent mixture with frangible means separating those components within the outer tube. When the frangible separating means is broken, the components combine within the outer tube and react to produce chemical light. The reaction is contained entirely within the outer tube so the light will not be extinguished by contact of the lightstick with water; the lightstick can even be used while submerged in water. Certain lightsticks can emit light of considerable intensity for several hours after actuation so they can be used as markers for rescue operations at night.

The assignee of the instant invention disclosed herein has been pioneer in this technology which it has disclosed to the public in numerous United States Patents, including the following:

| | |
|---|---|
| 3,325,417 | 3,704,231 |
| 3,329,621 | 3,704,309 |
| 3,352,791 | 3,711,415 |
| 3,366,572 | 3,718,599 |
| 3,391,068 | 3,720,622 |
| 3,391,069 | 3,729,426 |
| 3,399,137 | 3,732,297 |
| 3,400,080 | 3,734,862 |
| 3,425,949 | 3,749,630 |
| 3,431,264 | 3,749,677 |
| 3,442,813 | 3,749,679 |
| 3,442,814 | 3,752,406 |
| 3,442,815 | 3,775,336 |
| 3,442,816 | 3,781,329 |
| 3,470,103 | 3,804,891 |
| 3,511,612 | 3,816,325 |
| 3,539,574 | 3,816,326 |
| 3,539,794 | 3,816,795 |
| 3,557,233 | 3,821,229 |
| 3,576,987 | 3,843,549 |
| 3,584,211 | 3,875,602 |
| 3,597,362 | 3,888,786 |
| 3,630,941 | 3,894,050 |
| 3,637,784 | 3,909,440 |
| 3,644,517 | 3,911,038 |
| 3,654,525 | 3,914,255 |
| 3,671,450 | 3,948,797 |
| 3,677,957 | 3,970,660 |
| 3,691,085 | 3,974,086 |

-continued

| | |
|---|---|
| 3,697,432 | 3,974,368 |
| 3,701,738 | 3,978,079 |
| 4,017,415 | 3,994,820 |
| 4,053,430 | 4,064,064 |
| 4,064,428 | 4,076,645 |
| 4,308,395 | 4,313,843 |
| 4,338,213 | 4,366,079 |
| 4,401,585 | 4,405,513 |
| 4,407,743 | 4,50,305 |
| 4,462,931 | 4,282,357 |

Various lightstick assemblies useful in emergency are known. For instance, U.S. Pat. Nos. 3,900,728 and 4,193,109 disclose a lightstick assembly comprising a lightstick, a sleeve in which the lightstick is stored and an attached actuating device allowing activation of the lightstick with the use of only one hand. U.S. Pat. No. 4,186,426 discloses an emergency lighting device comprising the lightstick assembly of U.S. Pat. No. 3,900,728 and a container in which the assembly is retained such that a lantern-like light source is produced.

While the above devices have received commercial acceptability, an improved device which comprises a light source, a connecting means between the light source and its protective container is believed to provide a number of improvements in use. In the circumstances when emergency lighting devices such as the above are utilized, it may be important to retain both the lightstick and its container. For example, a lightstick cannot be selectively extinguished once activated. However, its insertion into an opaque container would effectively limit the emission of its produced light. Use of the lightstick and its container in conjunction would also enable its user to transmit coded signals to another over short distances. Absent a connecting means between these two components, retention both components may be difficult to accomplish under the conditions of anticipated use. The present invention preferably provides a lightstick in a package that is adapted for storage of the lightstick for ready access, and that is especially adapted for ease and convenience of use of the light in several kinds of emergency situations. The concept, however, is equally applicable to other chemical light sources and is not limited to sources in the form of lightsticks.

SUMMARY OF THE INVENTION

The present invention is directed to a lighting device comprising:

(a) a chemiluminescent light source;

(b) a container of sufficient diameter and length to accept the full length of said light source component upon insertion; and (c) a flexible connecting member having first and second ends, said first and seconds ends being attached to said light source and said container, respectively, said flexible connecting member further being of sufficient size to allow for sufficient movement of said lightstick relative to said container to permit the withdrawal and reinsertion of said light source into said container.

Generally, the chemiluminescent light source preferably employed will be in the form of the aforemention lightstick.

In a more preferred embodiment, the present invention is directed to a lighting device comprising:

(1) a cylindrical chemiluminescent lightstick having a tube cap permanently affixed to one end thereof;
(2) a tab integral with or permanent affixed to said tube cap, said tab extending from said tube cap in a direction substantially parallel to the length of said lightstick;
(3) a container having first and second ends, said container being of sufficient length and diameter to allow for the insertion of the entire lightstick into said container;
(4) an end cap, permanently affixed to said first end of said container, said end cap having an orifice integral therewith, said orifice adapted to permit the emergence of said tab from said container upon full insertion of said lightstick into said container;
(5) a container cap removably affixed to said second end of said container, said container cap being of greater diameter than said orifice of said end cap, and
(6) a lanyard permanently affixed to said end cap and said container cap, said lanyard having a cross section less than that of said orifice and being of sufficient length to permit the withdrawal of at least the entire length of said lightstick.

DETAILED DESCRIPTION OF THE INVENTION

Figure 1:
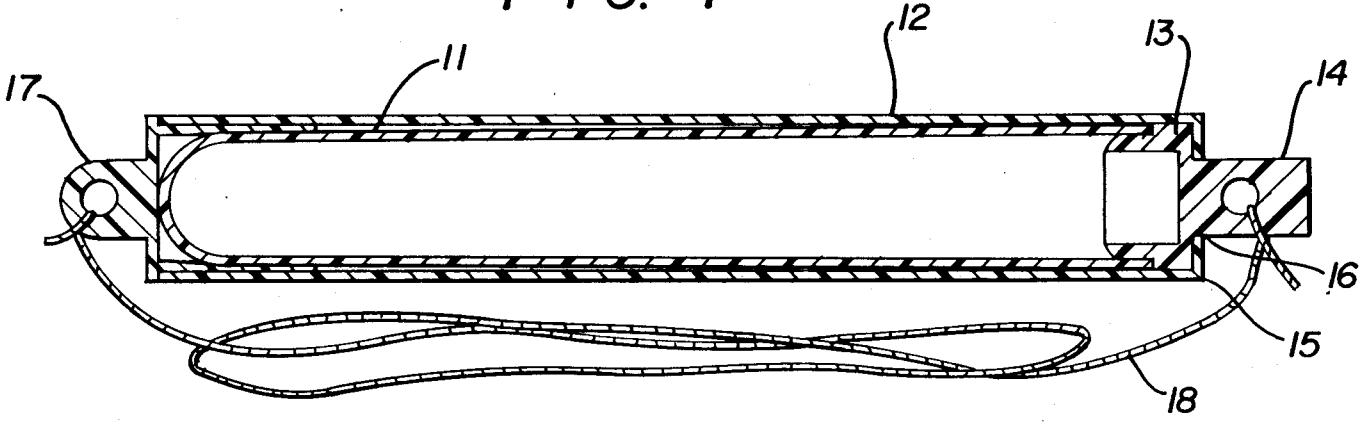

FIG. 1 is a schematic representation of a preferred embodiment of the claimed invention.

DETAILED DESCRIPTION OF THE INVENTION

The chemiluminescent lightstick is well known in the art. As stated above, it generally comprises a flexible transparent or translucent outer tube which contains several chemical components of a chemiluminescent mixture with frangible means separating those components within the outer tube. The frangible means may be broken thereby combining the components of said mixture within the outer tube and producing light through the chemiluminescent reaction which is radiated through said outer tube.

Typically, lightsticks comprise a flexible polyethylene outer tube sealed at both ends thereof and containing one or two glass vials which contain separate components of the chemiluminescent mixture. So long as the intact glass vials remain intact, the mixture components remain separated and no light is produced. Flexing of the outer tube breaks the vials and permits mixing of the components. Since the polyethylene outer tube is somewhat air permeable, it is preferred that all air-sensitive chemiluminescent components be contained in the glass vials to prevent their degradation. Components such as solvents and flourescers which are not air-sensitive may occupy space within the outer tube that is not occupied by the glass vials. This will improve the storage life of the lightstick obviating the need for placing the lightstick in a hermetically sealed envelope.

Chemiluminescent components of the lightstick useful in the practice of the present invention are also well known in the art. The choice of the chemiluminescent system used in the practice of the present invention is not critical. Reactive chemiluminescent mixtures which are useful in the practice of the present invention are disclosed in the assignee's previously referenced U.S. Patents, the contents of which are incorporated by reference herein.

The container component of the present invention should be property sized to accommodate the entire length of the lightstick. This is necessary so that the lightstick is adequately protected from premature ignition due to rough handing. Secondly, the container must be adapted to accept a removable cap on one end thereof and a fixed cap on the other end thereof in order to secure the lightstick within the container during storage and handling.

Preferably, the container is configured to accommodate the lightstick with minimal amount of additional interior void space. This allows for the production of a compact emergency lighting device which is readily storable. It is further preferred that the container be constructed of an opaque material such that the container may serve as a light barrier to allow for the selective shielding of the lightstick subsequent to its ignition.

The claimed device further comprises a flexible connecting member, the ends of which are connected to the lightstick and the container. The flexible member must be of sufficient length and flexibility to allow for sufficient movement of the lightstick relative to the container to permit for the withdrawal and reinsertion of the lightstick.

Preferably, the elongated flexible member is comprised of string, cord or elastic material. It is further preferred that the elongated flexible member is at least twice the length of said lightstick.

Hereinafter, an especially preferred embodiment of the present invention is described with reference to FIG. 1.

The preferred embodiment of the present invention comprises a cylindrical lightstick (11) being closed on one end thereof and having permanently affixed to the other end thereof a tube cap (13). Integral with said tube cap is tab (14) which extends from said tube cap in a direction substantially parallel to the length of said lightstick. The tab (14) is of sufficient length such that it extends through end cap (15) (hereinafter described) upon insertion of lightstick (11) into container (12). The tab further comprises a point of attachment, preferably a hole, for lanyard (18). The tab is further sized such that a sufficient length of the tab extends through the orifice to allow the tab to be used to eject the lightstick from the container upon the application of pressure.

The device further comprises cylindrical container (12). To one end of container (12) is permanently affixed end cap (15) upon which, perpendicular to the length of the container, is orifice (16). Container (12) and orifice (16) are sized such that tab (14) may extend therethrough upon the full insertion of lightstick (11) into cylinder (12). However, the orifice (11) must also be sized that container cap (17) (described below) is prevented from passing therethrough.

A container cap (17) is adapted to be removably affixed to the remaining end of the container to allow for removal of the lightstick (11) from container (12). An attachment point is also provided on container cap (17) to allow for attachment of one end of lanyard (18) which is preferably at least twice the length of lightstick (11).

It is preferred that the lightstick be retained within its container when the container cap (12) is removed from the container. This can be accomplished by minimizing the clearances between the lightstick and the container and/or the tab and the orifice, such that the application of pressure on the tab is necessary to withdraw the lightstick from the container.

To operate the device, lightstick (11) is first removed from container (12). This may be accomplished by manual removal of container cap (17) from the container (12) or by the application of pressure to tab (14) whereupon container cap (17) will ejected from the container. Lightstick (11) may then be activated by bending its body until the chemiluminescent reaction is initiated through breakage of the vial(s) contained within the lightstick. The lightstick may then be separated from the container to the full distance permitted by the lanyard (18). Complete separation of the lightstick (11) and container (12) is prevented, however since the dimensions of container cap (17) prevent its passage through orifice (16) of end cap (15).

The device of the claimed invention may be utilized as an emergency signal by activating the lightstick, grasping the container and swinging the device in the circular motion. The circular path scribed by the lightstick produces a light signature of far greater diameter than than produced by a lightstick alone, thereby producing an improved method of signaling. The present invention also may be used as a pen light when the container cap is removed while the activated lightstick in retained in the container.

We claim:

1. A light device comprising:
(1) a cylindrical chemiluminescent light source;
(2) a container having first and second ends, said container being of sufficient size to allow for the insertion of the entire light source into said container;
(3) an end cap, permanently affixed to said first end of said container, said end cap having an orifice integral therewith;
(4) a container cap removably affixed to said second end of said container, said container cap being of sufficient size to prohibit its passage through said orifice of said end cap; and
(5) a lanyard, one end of which is permanently affixed to said light source and the other end being attached to said container cap, said lanyard having a cross section less than that of said orifice and being of sufficient length to permit the withdrawal of at least the entire length of said light source from said container.

2. The device of claim 1 wherein said light source (a) comprises a tube circular in cross section, and said container (b) comprises a tube having a cross section which is circular and of a sufficient diameter to permit insertion of said light source (a).

3. A lighting device comprising:
(1) a cylindrical chemiluminescent lightstick having a tube cap permanently affixed to one end thereof;
(2) a tab integral with or permanently affixed to said tube cap, said tab extending from said tube cap in a direction substantially parallel to the length of said lightstick;
(3) a cylindrical container having first and second ends, said container being of sufficient length and diameter to allow for the insertion of the entire lightstick into said container;
(4) an end cap, permanently affixed to said first end of said container, said end cap having an orifice integral therewith, said orifice adapted to permit the emergence of said tab from said container upon full insertion of said lightstick into said container;
(5) a container cap removably affixed to said second end of said container, said container cap being of sufficient size to prohibit its passage through said orifice of said end cap; and
(6) a lanyard permanent affixed to said tube cap and said container cap, said lanyard having a cross section less than that of said orifice and being of sufficient length to permit the withdrawal of at least the entire length of said lightstick.

4. The device of claim 3 wherein said lanyard is at least twice the length of said lightstick.

5. The device of claim 3 wherein said tab of said tube cap is adapted to engage said orifice such that the application of pressure on said tab is necessary to remove said lightstick from within said container.

* * * * *